US005750327A

United States Patent [19]

Chang et al.

[11] Patent Number: 5,750,327

[45] Date of Patent: May 12, 1998

[54] MIXED RIPENERS FOR SILVER HALIDE EMULSION FORMATION

[75] Inventors: Yun Chea Chang; James Rodgers, both of Rochester; Joseph Philip Pepe, Penfield, all of N.Y.

[73] Assignee: Eastman Kodak Company, Rochester, N.Y.

[21] Appl. No.: 667,159

[22] Filed: Jun. 20, 1996

[51] Int. Cl.[6] ..... G03C 1/09; G03C 1/07; G03C 1/015

[52] U.S. Cl. ..... 430/569; 430/603; 430/611

[58] Field of Search ..... 430/569, 603, 430/611

[56] References Cited

U.S. PATENT DOCUMENTS

| | | | |
|---|---|---|---|
| 3,271,157 | 9/1966 | McBride . | |
| 3,784,381 | 1/1974 | Perignon . | |
| 4,057,429 | 11/1977 | De brabandere et al. . | |
| 4,078,937 | 3/1978 | Tani et al. | 430/569 |
| 4,469,784 | 9/1984 | Heki et al. | 430/567 |
| 4,477,564 | 10/1984 | Cellone et al. | 430/567 |
| 4,477,565 | 10/1984 | Himmelwright | 430/567 |
| 4,631,253 | 12/1986 | Mifune et al. | 430/569 |
| 4,668,614 | 5/1987 | Takada et al. | 430/567 |
| 4,695,534 | 9/1987 | Bryan et al. | 430/569 |
| 4,713,322 | 12/1987 | Bryan et al. | 430/569 |
| 4,722,886 | 2/1988 | Nottorf | 430/569 |
| 4,728,602 | 3/1988 | Shibahara et al. | 430/567 |
| 4,801,522 | 1/1989 | Ellis | 430/569 |
| 4,945,037 | 7/1990 | Saitou | 430/567 |
| 5,204,235 | 4/1993 | Yamamoto et al. | 430/569 |
| 5,246,825 | 9/1993 | Herz et al. | 430/569 |
| 5,364,754 | 11/1994 | Kim et al. | 430/569 |
| 5,500,336 | 3/1996 | Asanuma et al. | 430/569 |

FOREIGN PATENT DOCUMENTS

| | | | |
|---|---|---|---|
| 0 421 740 A1 | 4/1991 | European Pat. Off. | G03C 1/035 |
| 0 462 579 A1 | 12/1991 | European Pat. Off. | G03C 1/07 |

OTHER PUBLICATIONS

Herz, A., H., J. of Imaging Science and Technology, vol. 39(1), 1995, pp. 40–55.

*Primary Examiner*—Mark F. Huff
*Attorney, Agent, or Firm*—Paul A. Leipold

[57] ABSTRACT

The invention relates to a method of forming a silver halide emulsion comprising nucleating silver bromide nuclei while reactive contact with ammonia, a digestion said nuclei, bringing a thioether into reactive contact with said nuclei, growing the nuclei by addition of silver ion, iodide and bromide, wherein during at least the first portion of growth, the pH is maintained at about 9.

6 Claims, No Drawings

MIXED RIPENERS FOR SILVER HALIDE EMULSION FORMATION

FIELD OF THE INVENTION

This invention relates to formation of silver halide emulsion. It particularly relates to forming high iodide containing silver bromoiodide emulsions.

BACKGROUND OF THE INVENTION

Ripeners, silver halide solvents, or growth accelerators are often used in photographic emulsions to increase the solubility of silver halide and hence, the crystal grain size. U.S. Pat. No. 4,722,886—Nottorf teaches the use of ammonia as a growth accelerator A. Adin et al U.S. Pat. No. 5,364,754 (1994) teaches the use of organic dichalocogenides as ripeners. A. Herz and R. Klaus U.S. Pat. No. 5,246,825 (1993) teaches the use of organic ripening agents and group IIA salts to produce a super additive ripening effect. D. Klein U.S. Pat. No. 4,057,429 teaches the use of alkylthio alkylene carboxyamine as a ripening agent. A recent publication of A. Herz, J. of Imaging Science, 39(1) (1995) summarizes the ripening strength of different ripeners.

Ammonia is frequently used as a ripener. At pH 6 or below, ammonia is protonated into ammonium ion which shows little ripening strength. At pH 9 or higher, most ammonium ions convert into ammonia molecules, which show strong ripening strength. Ammonia, through its lone pair 30 of electrons, tends to have high affinity for silver ions. It is speculated that a certain amount of reduction sensitization is induced by ammonia and/or hydroxyl ions in a high pH environment. A certain amount of reduction sensitization improves the photographic emulsion speed. Ammonia seems to play dual roles by offering both ripening strength and reduction sensitization.

Unfortunately, ammonia's ripening strength is only moderate and is insufficient for low solubility material such as AgI, resulting in renucleation during precipitation. To mitigate the problem, such materials were precipitated very slowly, thus reducing productivity.

U.S. Pat. No. 4,668,614—Takada et al and U.S. Pat. No. 4,728,602—Shibahara et al disclose formation of monodispersed core/shell emulsions. However, such grains have been difficult to grow because of the long times to make them and renucleation of grains during the process.

It is particularly hard to grow high iodide silver bromoiodide conventional emulsions without renucleation and in short precipitation time.

PROBLEM TO BE SOLVED BY THE INVENTION

There is a need for preventing renucleation during precipitation of ammonia ripened silver bromoiodide emulsions, particularly those with a higher content of silver iodide. There is a need to improve ammonia's ripening strength for low solubility materials such as silver iodide to prevent renucleation during precipitation.

SUMMARY OF THE INVENTION

It is an object of the invention to provide renucleation free high speed ammonia ripened silver bromoiodide photographic emulsions.

It is another object of the invention to provide a more productive and timesaving method of making silver bromoiodide emulsions.

It is a further object of the invention to provide improved silver bromoiodide emulsions of greater uniformity.

These and other objects of the invention generally are accomplished by providing a method of forming a silver halide emulsion comprising nucleating silver bromide nuclei while in reactive contact with ammonia, digestion of said nuclei, bringing a thioether into reactive contact with said nuclei, and growing the nuclei by addition of silver ion, iodide and bromide, wherein during at least the first portion of growth, the pH is maintained at about 9.

ADVANTAGEOUS EFFECT OF THE INVENTION

This invention preserves the reduction sensitization environment created by the use of ammonia while overcoming the problem of renucleation in precipitating high iodide containing AgBrI emulsions of high photographic sensitivity. The invention has the effect of producing silver bromoiodide grains of improved uniformity. Further, the invention has the advantage that such silver bromoiodide emulsions are produced at lower cost and in shorter precipitation time.

DETAILED DESCRIPTION OF THE INVENTION

The invention has numerous advantages over prior formation processes for bromoiodides. The formation process is shorter, thereby lowering cost as less mixing power as utilized and equipment turnover is greater. Another advantage is that the shorter run times aid in preventing renucleation. Gel hydrolysis is less, and less peptization is lost in shorter run times. The invention also has the advantage that the silver bromoiodide grains formed are more uniform in size and properties. The invention allows the reliable formation of larger uniform silver bromoiodide grains without renucleation. Another advantage of the invention is that the grains formed by the invention allow the formation of a fast blue layer for use in negative film formation. These and other advantages of the invention will be apparent from the description below. It has been found in the invention that a mixture of ammonia with another strong silver halide solvent (thioether) can reduce renucleation during the formation of high speed silver bromoiodide photographic emulsions.

The invention may be utilized in the formation of any silver bromoiodide grains. However, it finds particular use in core/shell grains where there is a high iodide core surrounded by a layer that contains less iodide. A most preferred grain is a grain, having a high iodide core, that is octahedral in shape and greater than 1.5 μm in average grain size. The grain size is typically between about 0.5 and 2.5 micrometers.

In the grains of the invention the overall iodide content may range between about 1% and 35%. A suitable overall range has been found to be between about 5% and 25% range. The invention finds its most preferred grain in a range above 9% total silver iodide in the grains with a preferred range being 9% to 20% by weight silver iodide. The core is suitably between 20 and 40 percent silver iodide. The grain volume making up the core is generally between about 10 and 50 percent of the total volume. The preferred core/shell structure has 18 percent total silver iodide with a 36 percent silver iodide phase in the core.

The invention combination of a thioether and ammonia to maintain a pH above about 9 during at least the beginning portion of growth prevents renucleation and also shortens the time of the formation of a silver bromoiodide grain, as materials may be added faster so that run times are short. The ammonia is maintained in the concentration of between about 0.01 molar and 0.5 molar. The pH is maintained between about 9 and 10 with about 9 being preferred.

The source of ammonia during the beginning of growth and during nucleation may be any suitable source. Typical of such sources are ammonia gas and ammonia sulfate Preferred sources of ammonia are ammonia salts such as ammonia chloride and ammonia bromide. Ammonia sulfate has been found to be particularly preferred because it has no halide counter ions.

Any effective thioether may be utilized as the strong ripener of the invention. Typical of such thioether materials are 1,8-dihydroxyl-3,6-dithiaoctane, 1,4,10,13-tetrathia-7,16-dioxacyclooctadecane, 1,7-dithia-4,10-dioxacyclododecane, 1,3,5-trithiane, 3,6,9,12-tetrathiatetradecane-1,14-dioicacid, ethylmercaptoacetic acid, 3,5-dithiaheptane-1,7-dioicacid, 3,7-dithianoname 1,9-dioicacid, 3,8-dithiadecane-1,10-dioicacid, 2- ethylmercaptoethanol. The preferred material is 1,10-dithia-4,7,13,16-tetraoxacyclooctadecane as this material is an effective ripening agent, and when used with the ammonia of the invention provides a particularly uniform grain.

The high pH of between about 9 and 10 is not maintained during the entire period of growth. In the latter stages of growth the addition of reactants is slowed, less iodide is added in a core/shell emulsion, and the pH may be lowered during low iodide addition to a range of between about 5 and 7, with a preferred range being about 5.5 to 6.

The period of high pH of between about 9 and about 10 may be any suitable portion of the growth of the grain. Typically, it will be until a volume of between about 1 and 95% of the total volume of the grain is deposited and generally at least until completion of the high iodide core.

Generally, nucleation of the silver bromoiodide grains of the invention is carried out with nucleation of generally pure silver bromide with pH adjustment and addition of iodide being carried out after a short holding in the digestion period. The emulsions may be used in any photographic element. They find their preferred use in color negative materials. The silver halide grains formed by the invention may have dopants or other modifiers such as disclosed in *Research Disclosure* 36544 of Sep. 1994, Section I, added during grain formation. The grains may be chemically and spectrally sensitized by conventional techniques such as disclosed in *Research Disclosure* 36544 in Sections IV and V. Antifoggants and stabilizers such as disclosed in *Research Disclosure* 36544, Sections VI and VII, also may be used with the emulsions of the invention.

The following examples illustrate the practice of this invention. They are not intended to be exhaustive of all possible variations of the invention. Parts and percentages are by weight unless otherwise indicated.

EXAMPLES

Precipitation

Example A (Invention)

This example demonstrates that mixing a stronger ripener (1,10-dithia-4,7,13,16-tetraoxacyclooctadecane with ammonia can produce an emulsion that was narrowly dispersed in size and essentially free of smaller grain populations caused by renucleation.

To a reactor containing 88 g of gelatin, 7.5 g of sodium bromide and 18.8 g of ammonium sulfate were added 4,189 g of distilled water. The reaction vessel was vigorously stirred and maintained at 80° C. and pH 9.0. Sodium bromide and silver nitrate solutions, both 0.45 M, were then added to the reaction vessel at accelerated flow rates from 26.9 cc/min to 61.5 cc/min for 11.5 minutes. The reaction mixture was held for 3 minutes while another solution containing 1.47 g of 1,10-dithio-4,7,13,16-tetraoxacycloododecane and 34.5 g of ammonia sulfate in 470 g of water was added. Then a 0.45 M solution of silver nitrate was added along with a 0.45 M bromoiodide solution (36% iodide) in linearly accelerated flow rates from 11.4 to 77.2 cc/min for 22.4 minutes. The solutions were then changed to 2 M silver nitrate and 2 M bromoiodide (36% iodide) and added in linearly accelerated flow rates from 11.4 to 83.4 cc/min for 48 minutes with pAg maintained at 8.56. The pH of the reaction vessel was then adjusted to pH 5.5. A 2 M silver nitrate solution and a 2 M bromoidide solution (10% iodide) were then added in linearly decelerated flow rates from 22.9 to 11.4 cc/min in 18.8 minutes to ramp down the pAg from 8.56 to 6.41. This was followed by linearly accelerated flow rates from 22.9 to 65.8 cc/min in 30.4 minutes with pAg maintained at 6.41. After that, 466 g of a 5 M sodium bromide solution was added to the reaction vessel, followed by single jet addition of 2 M silver nitrate at 76.5 cc/min for 30 minutes. The resulting emulsion was essentially free of fine particles (no renucleation) and exhibited a sharp size distribution that had a coefficient of variation (COV) of 8% with a mean size of 1.6 μm.

Example B (Comparative)

This example demonstrates that ammonia alone was insufficient for dealing with high iodide containing AgBrI precipitations. A renucleation problem occurred in the absence of stronger ripeners.

This emulsion was made similar to Example A except that no 1,10-dithia-4,7,13,16-tetraoxacyclooctadecane was added to the precipitation. The resulting emulsion was severely contaminated by fine particles due to renucleation as shown by scanning electron micrograph. More than 50 percent by number of the grains were fines of less than 0.3 micrometer.

Example C (Comparative)

This example demonstrates that without the use of ammonia, the emulsion showed inferior photographic performance.

This emulsion recipe was similar to emulsion A except that 0.75 g of 1,10-dithia-4,7,13,16-tetraoxacyclooctadecane (instead of ammonia sulfate) was added to the initial reactor and 1.47 g of the same ripener (instead of the ammonia sulfate and 1,10-dithia-4,7,13,16-tetraoxacyclooctadecane combination) was added during the course of the precipitation. The pH of the reaction vessel was maintained at 5.5 throughout the make. The recipe was scaled down to 0.66 X of the original batch size and the emulsion was made accordingly. The resulting emulsion was essentially free of fine particles and the grain size distribution had a COV of 20.3% with a mean size of 1.46 μm.

Sensitization

The emulsion of Example A (Invention) was sensitized for photographic evaluation as follows: 0.063 moles of raw emulsion were melted at 40° C. to which was subsequently added 0.0057 g of sodium thiocyanate, 0.00003 g of sodium thiosulfate, 0.000066 g of sodium aurous(I)dithiosulfate and 0.0038 g of 3-(2-methylsulfamoyl-ethyl)-benzothiazolium tetrafluoroborate. The sensitized emulsion was then heated to 65° C. and held there for 20 minutes.

The emulsion of Example B (Comparative) was not sensitized due to severe renucleation.

The emulsion of Example C (Comparative) was sensitized in a similar manner to Example A with 0.0057 g of sodium thiocyanate, 0.000039 g of sodium thiosulfate, 0.000079 g of sodium aurous(I)dithiosulfate and 0.0038 g of 3-(2-methylsulfamoylethyl)-benzothiazoliumtetrafluoroborate. The sensitized emulsion was then heated to 65° C. and held there for 30 minutes.

Photographic Comparison

Both emulsions were coated in a model single layer employing 0.969 g/m$^2$ of N-{2-chloro-5-[(hexadecylsulfonyl)amino]phenyl}-2-{4-[(4-hydroxyphenyl)sulfonyl]phenoxy}-4,4-dimethyl-3-oxo-pentamide yellow coupler and 1.61 g/m$^2$ of silver stabilized with 26.2 g/m$^2$ of sodium 4-hydroxy-6-methyl-1,3,3a,7-tetraazindene. The coatings were exposed on a step tablet, processed in a standard C-41 developer and read to blue light on a sensitometer. Minimum density, speed at 0.15 density units above minimum density and maximum gamma are recorded below.

| Sample | Minimum Density | Speed at 0.15 Density Units Above Minimum | Maximum Gamma |
|---|---|---|---|
| Emulsion A | 0.13 | 245 | 0.73 |
| Emulsion B (Comparison) | Not Sensitized | Not Sensitized | Not Sensitized |
| Emulsion C (Comparison) | 0.28 | 184 | 0.56 |

As the above table readily demonstrates, not only is the invention emulsion significantly higher in sensitivity, but it is also less foggy with better gradation than the comparison emulsion.

The invention has been described in detail with particular reference to preferred embodiments thereof, but it will be understood that variations and modifications can be effected within the spirit and scope of the invention.

We claim:

1. A method of forming a silver halide emulsion comprising nucleating silver bromide nuclei while in reactive contact with ammonia, digesting said nuclei, bringing a thioether into reactive contact with said nuclei, and growing the nuclei by addition of silver ion, iodide and bromide, wherein during a period that extends for 1 to 95 percent of the growth of the grain, the pH is maintained at between 9 and 10, wherein the grains of said silver halide emulsion have an iodide content of between 5 and 20% iodide, and wherein the grains of said emulsion have a size of between 0.5 and 2.5 μm.

2. The method of claim 1 wherein said thioether comprises 1,10-dithia-4,7,13,16-tetraoxacyclooctadecane.

3. The method of claim 1 wherein said method comprises adding further ammonia during growth.

4. The method of claim 1 wherein said ammonia is added by means of ammonium sulfate.

5. The method of claim 1 wherein said emulsion comprises silver bromoiodide grains of octahedral structure.

6. The method of claim 1 wherein the time of formation of said emulsion is less than 3 hours.

* * * * *